US008939175B2

(12) United States Patent
Lea et al.

(10) Patent No.: US 8,939,175 B2
(45) Date of Patent: Jan. 27, 2015

(54) FLUID DELIVERY SYSTEMS

(75) Inventors: Benjamin Lea, Redditch (GB); Nigel Paul Sansum, Quedgeley (GB)

(73) Assignee: Kohler Mira Limited (GB)

( * ) Notice: Subject to any disclaimer, the term of this patent is extended or adjusted under 35 U.S.C. 154(b) by 218 days.

(21) Appl. No.: 13/387,644

(22) PCT Filed: Jul. 30, 2010

(86) PCT No.: PCT/GB2010/051262

§ 371 (c)(1), (2), (4) Date: Jan. 27, 2012

(87) PCT Pub. No.: WO2011/015853

PCT Pub. Date: Feb. 10, 2011

(65) Prior Publication Data

US 2012/0125464 A1 May 24, 2012

(30) Foreign Application Priority Data

Aug. 1, 2009 (GB) ..... 0913462.8

(51) Int. Cl.
*F16K 11/065* (2006.01)
*E03C 1/02* (2006.01)

(52) U.S. Cl.
CPC ..... *E03C 1/023* (2013.01)
USPC ..... 137/872; 137/625.48; 251/344

(58) Field of Classification Search
USPC ..... 251/344; 137/872, 874, 625.48, 625.11
See application file for complete search history.

(56) References Cited

U.S. PATENT DOCUMENTS

| | | | | | |
|---|---|---|---|---|---|
| 805,237 | A | * | 11/1905 | Sears | 55/303 |
| 2,000,791 | A | * | 5/1935 | Schmiedeknecht | 4/570 |
| 2,041,002 | A | * | 5/1936 | Kreuzer et al. | 137/625.48 |
| 2,043,668 | A | * | 6/1936 | Kohler | 137/625.5 |
| 2,119,534 | A | * | 6/1938 | Gerber | 137/596 |
| 2,509,671 | A | * | 5/1950 | Christensen | 251/344 |
| 3,236,253 | A | * | 2/1966 | Symmons | 137/119.05 |
| 3,425,664 | A | * | 2/1969 | Niskin | 251/344 |
| 3,441,054 | A | * | 4/1969 | Mellan | 137/872 |
| 3,642,249 | A | * | 2/1972 | Cruse | 251/344 |
| 3,722,800 | A | * | 3/1973 | Shames et al. | 239/447 |
| 3,731,716 | A | * | 5/1973 | Darish | 141/117 |

(Continued)

FOREIGN PATENT DOCUMENTS

| | | | |
|---|---|---|---|
| EP | 0289770 | A2 | 11/1988 |
| GB | 2237358 | A | 5/1991 |
| WO | WO 01/90615 | A1 | 11/2001 |

OTHER PUBLICATIONS

International Search Report and Written Opinion for International Application No. PCT/GB2010/051262, mail date Feb. 9, 2011, 10 pages.

*Primary Examiner* — John Rivell
*Assistant Examiner* — David Colon Morales
(74) *Attorney, Agent, or Firm* — Foley & Lardner LLP

(57) ABSTRACT

A fluid delivery system has an inner pipe (10) and an outer pipe (12). The inner pipe (10) is fixed and the outer pipe (12) is slidable relative to the inner pipe (10) in an axial direction lengthwise of the inner pipe (10). The inner pipe (10) has an inlet (2) and an outlet (4). The outer pipe (12) has two outlets (6 and 8). The inlet (2) is connectable to a fluid source and the outlets are connectable to appliances such as a shower, bath or washbasin. The outer pipe (12) is slidable along the inner pipe (10) to connect selectively the inlet (2) to one or more of the outlets (4, 6, 8) individually or in combination.

17 Claims, 9 Drawing Sheets

(56) References Cited

U.S. PATENT DOCUMENTS 3,859,985 A * 1/1975 Eckhart ..... 251/344
5,141,016 A * 8/1992 Nowicki ..... 137/118.07
6,135,154 A 10/2000 Chen et al.
6,279,610 B1 * 8/2001 Fan ..... 137/625.48
6,311,727 B1 * 11/2001 Campau ..... 137/625.48
6,920,892 B2 * 7/2005 Agresta et al. ..... 137/119.04

* cited by examiner

FLUID DELIVERY SYSTEMS

CROSS-REFERENCE TO RELATED APPLICATIONS

This application is a national stage application of International Application No. PCT/GB2010/051262, filed on Jul. 30, 2010, which in turn claims the benefit of priority of Great Britain Application No. 0913462.8, filed on Aug. 1, 2009. The entire disclosures of International Application No. PCT/GB2010/051262 and Great Britain Application No. 0913462.8 are each hereby incorporated by reference for all purposes in their entireties as if fully set forth herein.

This invention concerns improvements in or relating to fluid delivery systems and has particular, but not exclusive, application to ablutionary installations for washing, showering and bathing. More especially, the invention relates to a water delivery system for supplying water to any one or more of a plurality of outlets according to user selection.

Diverter valves are known for directing a supply of temperature controlled water from a mixer valve to a bath filler or a shower head. The known diverter valves are usually manually operable by a push button or lever to actuate the valve to switch the flow of water to a selected outlet.

The present invention seeks to provide an improved fluid delivery system.

It is a preferred object of the invention to provide a fluid delivery system which permits fluid flow to be selectively diverted to one or more outlets separately or in combination.

It is another preferred object of the invention to provide a fluid delivery system which can be retro-fitted to an existing flow-line to provide one or more additional outlets for increased functionality.

According to one aspect of the present invention there is provided a fluid delivery system having an inlet for connection to a fluid supply and at least two outlets, and diverter means for controlling fluid flow between the inlet and the outlets, the diverter means including a first member and a second member that are movable relative to each other in an axial direction to connect the inlet to a selected outlet.

The first and second members may comprise tubular members such as pipes, preferably inner and outer tubular members where one tubular member may be fixed and the other tubular member is movable relative to the fixed tubular member in the axial direction. The tubular members may be arranged concentrically. The inner tubular member may be fixed and the outer tubular member movable or vice versa. The inlet may be provided by the fixed tubular member. The outlets may be provided by the fixed tubular member. Alternatively, the outlets may be provided by the movable tubular member. Alternatively, at least one outlet may be provided by the fixed tubular member and at least one outlet may be provided by the movable tubular member.

In a preferred arrangement, the inlet and at least one outlet are provided by the fixed tubular member, preferably at the ends thereof. In this way, the system may be built into a flow-line by connecting the flow-line to the inlet and outlet at opposite ends of the fixed tubular member. The system may be retrofitted to an existing installation having a flow-line that delivers fluid to an existing outlet such as a shower head, bath or washbasin thereby providing one or more additional outlets supplied from an existing fluid source and providing increased functionality by user selection of one or more outlets. Alternatively, the system may be incorporated into a new installation.

In a preferred arrangement, the inner tubular member is fixed and the outer tubular member is slidably mounted on the inner tubular member and defines therewith a series of annular flow channels selectively connectable to the inlet and to one or more outlets according to the relative axial position of the inner and outer tubular members for diverting fluid flow from the inlet to a selected outlet(s). The flow channels may divert fluid flow from the inlet to the outlets individually or in combination.

The inner tubular member may communicate with the flow channels by any suitable means, for example one or more holes, slots or the like may be provided in the wall of the inner tubular member for fluid to flow from the inlet to a flow channel aligned with the hole(s).

There may be a flow channel that isolates the inlet from the outlets so that flow can be shut-off. There may be a flow channel that connects the inlet to an outlet associated with the outer tubular member. There may be a flow channel that connects the inlet to an outlet associated with the inner tubular member. There may be a flow channel that connects the inlet to more than one outlet associated with one or both tubular members at the same time.

Where an outlet provided by the outer tubular member communicates with a flow channel, fluid can flow from the inlet to the outlet when the flow channel is aligned with the hole(s) in the inner tubular member.

Where an outlet provided by the inner tubular member communicates with a flow channel, fluid can flow from the inlet to the outlet when the flow channel is aligned with the hole(s) in the inner tubular member.

Where two or more outlets communicate with a flow channel, fluid can flow from the inlet to the outlets when the flow channel is aligned with the hole(s) in the inner tubular member.

According to another aspect of the invention, there is provided an ablutionary installation having a fluid delivery system according to the previous aspect of the invention.

The inlet may be connectable to a source of temperature controlled water such as a mixer valve or an instantaneous water heater for delivery to one or more of a shower, bath, washbasin connectable to an outlet.

According to another aspect of the invention, there is provided a flow diverter device having an inlet and a plurality of outlets, the inlet being selectively connectable to one or more outlets for directing flow from the inlet to the selected outlet(s) by relative axial sliding movement of inner and outer tubular members.

The inner member may be fixed and the outer member slidable relative thereto for connecting the inlet to the selected outlet(s). The members may be arranged concentrically. The members may define at least two flow channels therebetween. The inlet may be connectable to at least one outlet via a flow channel. Relative axial sliding movement of the members may change the flow channel and/or the outlet(s) connected to the flow channel to change the fluid flow through the device.

In one preferred embodiment, the inlet is associated with one of the members, preferably the fixed member, and at least one outlet is associated with the other member. At least one outlet may also be associated with the member associated with the inlet.

Where an inlet or outlet is associated with the movable member, it will be configured to accommodate such movement. For example a flexible or telescopic connection may be employed to accommodate axial sliding movement. Alternatively, axial sliding movement may simply re-position an outlet fitting such as a spray head without requiring any special fluid connection.

In another preferred embodiment, the inlet and outlets are associated with one of the members, preferably the fixed member. With this arrangement, fluid connections of the movable member can be avoided.

According to another aspect of the invention, there is provided a method of adding one or more outlets to an installation having a fluid source and at least one fluid outlet by connecting a fluid delivery system or flow diverter device according to the preceding aspects of the invention between the fluid source and the at least one fluid outlet.

The method may include connecting the inlet of the system or device to the flowline from the fluid source and connecting an outlet of the system or device to the flowline to the outlet of the installation.

The method may include connecting the system or device where a user can grasp and move the movable member to select the outlet or outlets to be connected to the fluid source.

Embodiments of the invention will now be described in more detail by way of example only with reference to the accompanying drawings in which.

Figure 1:
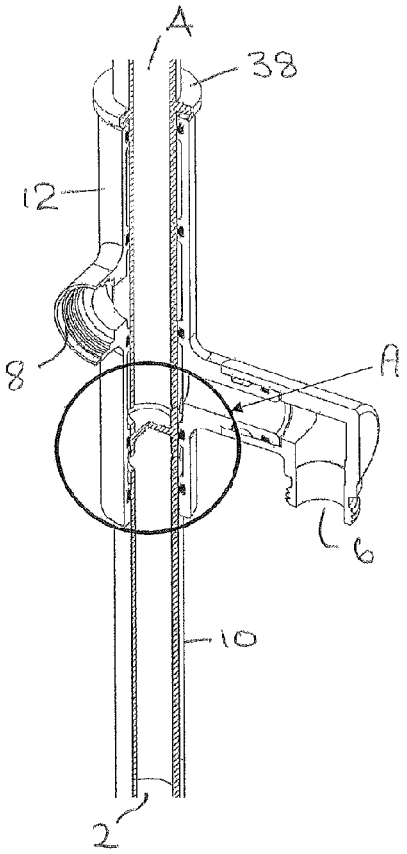
FIG. 1 is a cut-away perspective view of a water diverter system according to a first embodiment of the invention with the diverter arranged in a flow-off position.

The following description highlights features of the present invention by describing preferred embodiments. This description is not intended to be limiting in any way, and various features and characteristics may be modified or changed while continuing to be within the scope of the present invention.

Referring first to FIGS. 1 to 12 of the drawings, there is shown a first embodiment of a water diverter system for a water supply according to the invention. The water diverter system has a water inlet 2 and three water outlets 4,6,8. The system may be employed in an ablutionary installation for directing water from a source connected to the inlet 2 to one of the outlets 4,6,8 (FIGS. 1 and 2) or one or more of the outlets 4,6,8 (FIGS. 3 to 12) according to user selection.

By way of example, the inlet 2 may be connected to a source of temperature controlled water such as a mixer valve or an instantaneous water heater and the outlets 4,6,8 may supply temperature controlled water to an overhead shower, a body shower and a shower handset. It will be understood the invention is not intended to be limited to such arrangement and that other arrangements are envisaged and within the scope of the invention. For example an outlet may be connected to a bath filler.

The system includes two pipes 10,12 that are axially slidable relative to one another to control the flow of water from the inlet 2 to the selected outlet(s) 4,6,8. It will be understood that the term "pipe" is used for convenience to refer to a member through which fluid can flow and is not intended to be limiting.

The pipes 10,12 are preferably arranged one inside the other, i.e. a tube-in-tube arrangement, and are preferably arranged concentrically. The pipes are preferably cylindrical but other shapes are possible. In this embodiment, the inner one of the pipes 10 is fixed and the outer pipe 12 is slidable along the inner pipe 10. This is not essential however and the outer pipe 12 may be fixed and the inner pipe 10 slidable within the outer pipe 12. It will be understood that the terms "inner" and "outer" are used for convenience to refer to the relative arrangement of the pipes and is not intended to be limiting.

In this embodiment, the inlet 2 and outlet 4 are provided by the inner pipe 10, and the other two outlets 6, 8 are provided by the outer pipe 12. This is not essential however and other arrangements of the inlet 2 and outlets 4,6,8 may be employed.

A transverse partition wall 14 separates the inlet 2 from the outlet 4 and the inner pipe 10 is provided with two annular arrays of through holes 16,18 in the pipe wall either side of the partition wall 14. The holes 16 form an inlet array communicating with the inlet 2 and the holes 18 form an outlet array communicating with the outlet 4. Each array consists of a plurality of holes, in this case, two, although more than two may be employed. In some applications one or both arrays may be replaced by a single hole. It will be understood that the term "hole" is used for convenience to refer to any opening in the pipe wall and is not intended to be limiting.

The outer pipe 12 is provided with five internal ribs or lands 20,22,24,26,28 in which O-ring seals 20*a*,22*a*,24*a*,26*a*,28*a* are mounted. The O-ring seals 20*a*,22*a*,24*a*,26*a*,28*a* are axially spaced apart and provide a fluid-tight seal with the outer surface of the inner pipe 10 to separate an annular clearance gap between the pipes 10,12 into four annular flow channels 30,32,34,36. As shown the outlet 6 communicates with the flow channel 32 and the outlet 8 communicates with the flow channel 34.

In use, the outer pipe 12 is axially slidable along the inner pipe 10 to select the flow channel(s) 30,32,34,36 communicating with the inlet and outlet arrays of holes 16,18 and thus control the flow of water from the inlet 2 to the selected outlet(s) 4,6,8 individually or in combination.

Figure 2:
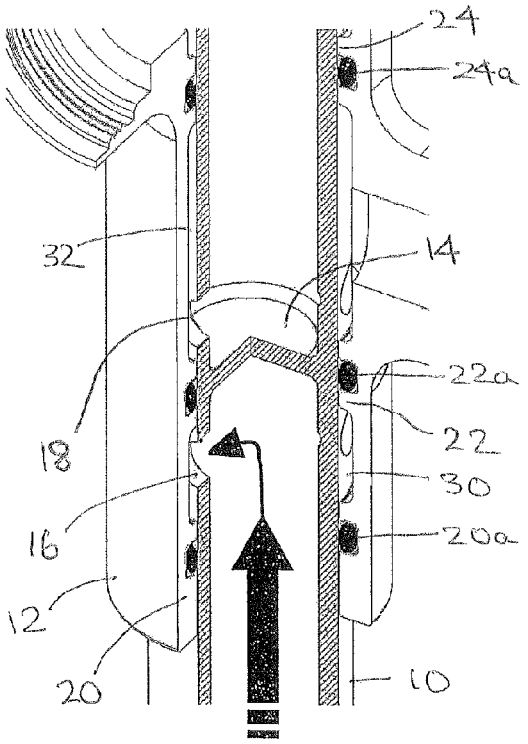
FIG. 2 is an enlarged detail view of the area A in FIG. 1.

FIGS. 1 and 2 show the diverter system in a flow-off position in which the inlet 2 communicates with the flow channel 30 via the array of holes 16 in the wall of the inner pipe 10. In this position, the outlets 4,6,8 are isolated from the flow channel 30 and flow of water from the inlet 2 to the outlets 4,6,8 is prevented.

The outer pipe 12 is axially located relative to the inner pipe 10 in the flow-off position by engagement with an abutment 38 on the inner pipe 10. In this embodiment the abutment 38 is provided by an annular collar or flange but it will be understood that other means of axially locating the outer pipe 12 may be employed.

Axial movement of the outer pipe 12 away from the abutment 38 brings the inlet 2 into communication with the flow channels 32,34,36 in turn.

Figure 3:
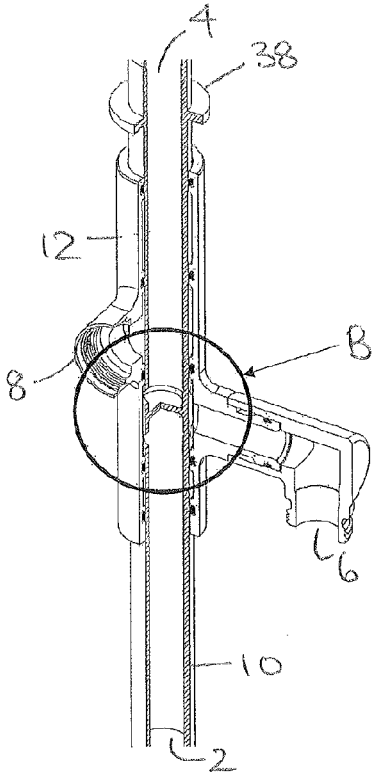
FIG. 3 is a cut-away perspective view of the water diverter system of FIG. 1 with the diverter arranged in a first flow-on position.
Figure 4:
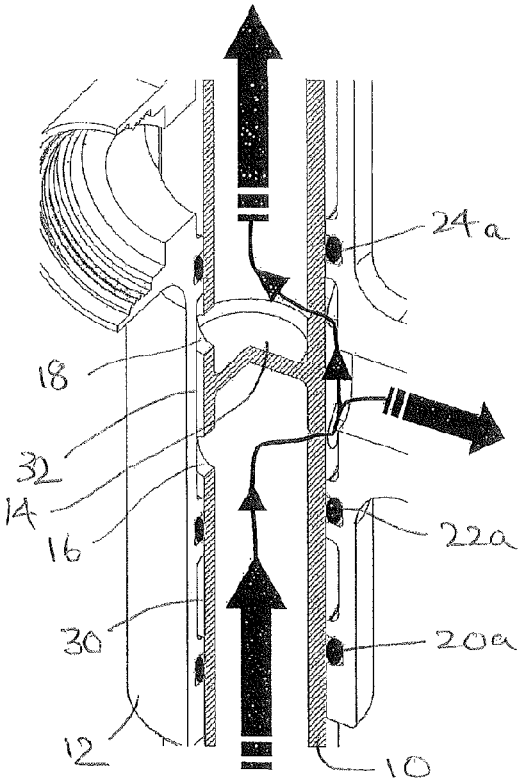
FIG. 4 is an enlarged detail of the area B in FIG. 3.

FIGS. 3 and 4 show a first flow-on position in which both arrays of holes 16,18 open to the flow channel 32 so that the inlet 2 communicates with the outlet 6 and also with the outlet 4.

Figure 5:
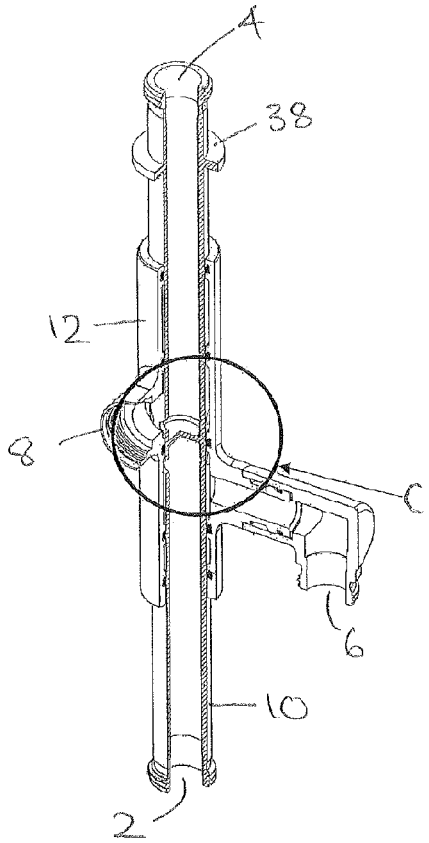
FIG. 5 is a cut-away perspective view of the water diverter system of FIG. 1 with the diverter arranged in a second flow-on position.
Figure 6:
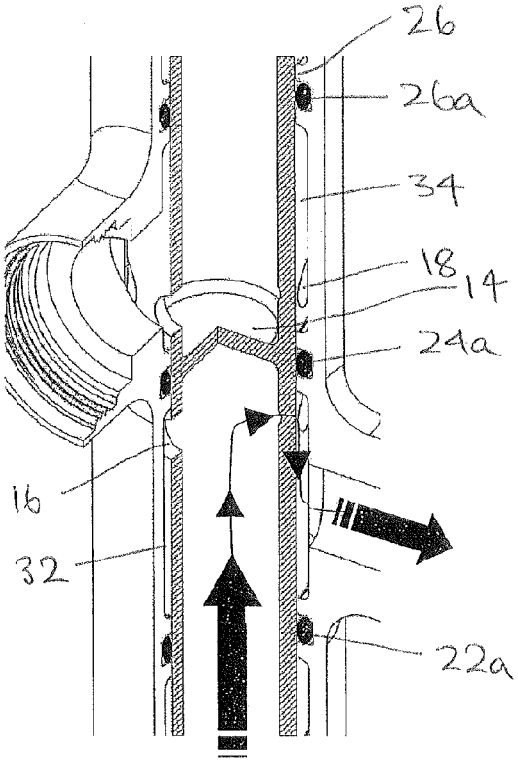
FIG. 6 is an enlarged detail view of the area C in FIG. 5.

FIGS. 5 and 6 show a second flow-on position in which the array of holes 16 opens to the flow channel 32 and the array of holes 18 is isolated from the flow channel 32 so that the inlet 2 communicates with the outlet 6 only.

Figure 7:
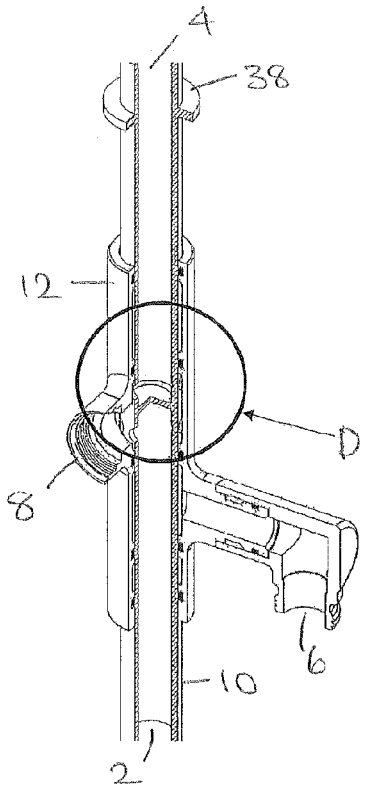
FIG. 7 is a cut-away perspective view of the water diverter system of FIG. 1 with the diverter arranged in a third flow-on position.
Figure 8:
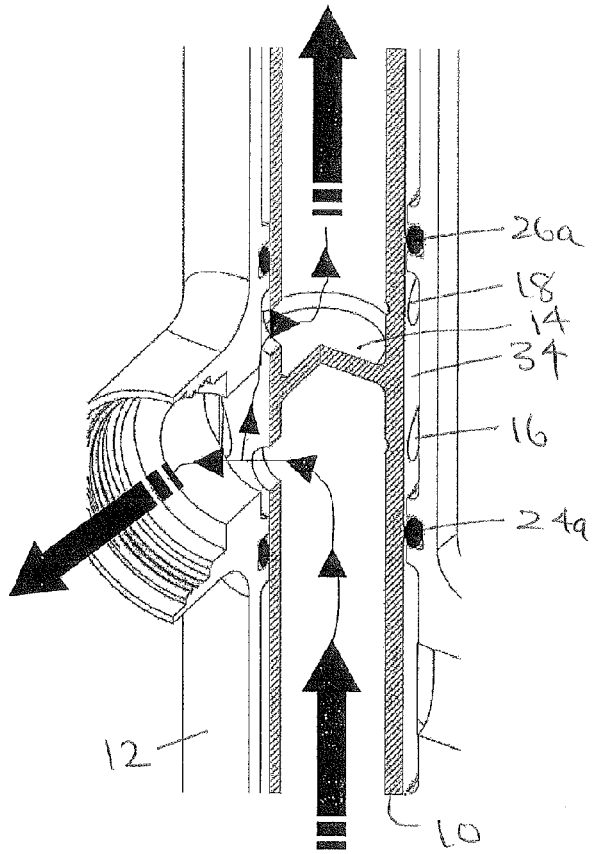
FIG. 8 is an enlarged detail view of the area D in FIG. 7.

FIGS. 7 and 8 show a third flow-on position which both arrays of holes 16,18 open to the flow channel 34 so that the inlet 2 communicates with the outlet 8 and also with the outlet 4.

Figure 9:
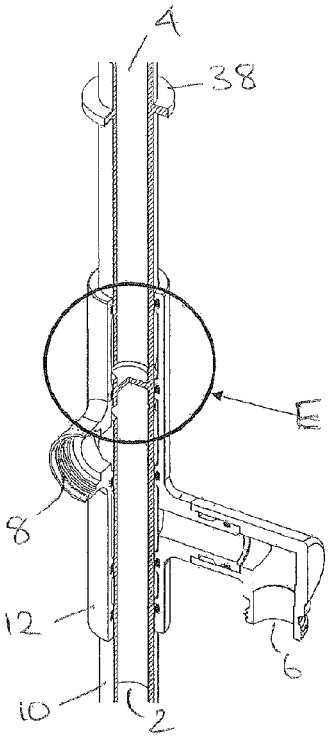
FIG. 9 is a cut-away perspective view of the water diverter system of FIG. 1 with the diverter arranged in a fourth flow-on position.
Figure 10:
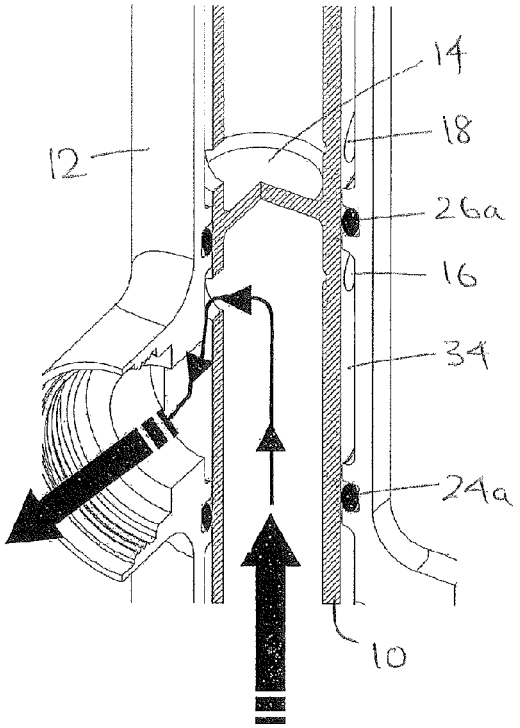
FIG. 10 is an enlarged detail view of the area E in FIG. 9.

FIGS. 9 and 10 shown a fourth flow-on position in which the array of holes 16 opens to the flow channel 34 and the array of holes 18 is isolated from the flow channel 34 so that the inlet 2 communicates with the outlet 8 only.

Figure 11:
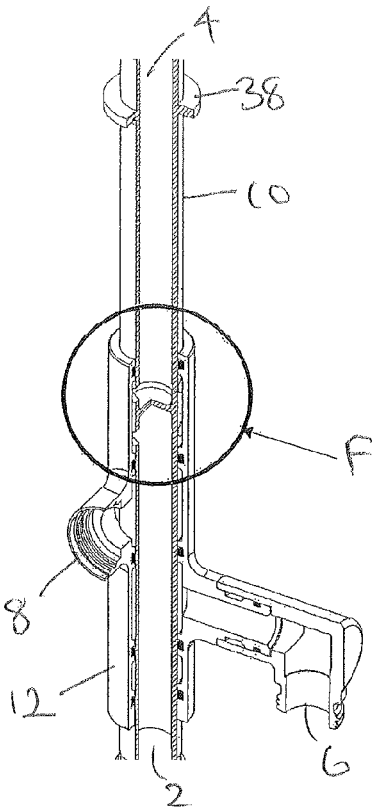
FIG. 11 is a cut-away perspective view of the water diverter system of FIG. 1 with the diverter arranged in a fifth flow-on position.
Figure 12:
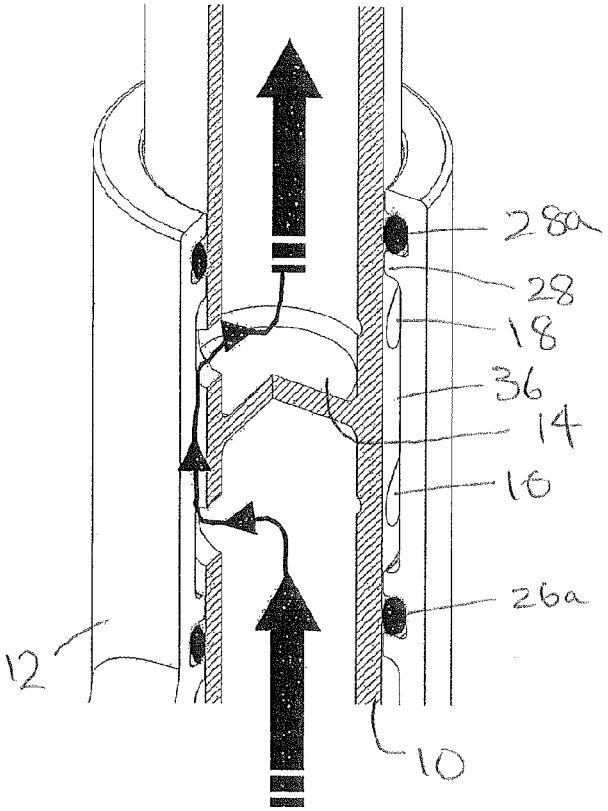
FIG. 12 is an enlarged detail view of the area F in FIG. 11.

FIGS. 11 and 12 show a fifth flow-on position in which both arrays of holes 16,18 open to the flow channel 36 so that the inlet 2 communicates with the outlet 4 only.

The outer pipe 12 may be movable beyond the position shown in FIGS. 11 and 12 to a second flow-off position (not shown) in which the array of holes 16 communicates with the flow channel 36 and the array of holes 18 is isolated from the flow channel 36 so that flow of water from the inlet 2 to the outlets 4,6,8 is again prevented.

In the above-described embodiment, the position of the outlets 6,8 associated with the outer pipe 12 changes with axial movement of the outer pipe 12 relative to the inner pipe 10 to select the outlet(s) 4,6,8 connected to the inlet 2 and the outlets 6,8 are configured to accommodate such movement.

By way of example, a flexible hose (not shown) may be connected to the outlet 6 for delivering fluid to a spray head or handset for a shower, and a spout (not shown) may be connected to the outlet 8 for delivering fluid to a bath or wash-basin. Other arrangements to accommodate change in position of the outlets 6,8 will be apparent to those skilled in the art.

Referring now to FIGS. 13 to 18 of the drawings, there is shown a second embodiment of a water diverter system for a water supply according to the invention in which like reference numerals in the series 100 are used to indicate parts the same or similar to the previous embodiment.

In this embodiment, the water diverter system has a water inlet 102 and two water outlets 104,106. The system may be employed in an ablutionary installation for directing water from the inlet 102 to the outlets 104,106 separately (FIGS. 13,14,15,16) or in combination (FIGS. 17,18) according to user selection.

By way of example, the inlet 102 may be connected to a source of temperature controlled water such as a mixer valve or an instantaneous water heater and the outlets 104,106 may supply temperature controlled water to an overhead shower and a shower handset or a bath filler. It will be understood the invention this is not intended to be limited to such arrangement and that other arrangements are envisaged and within the scope of the invention.

The system includes two pipes 110,112 axially slidable relative to one another to control the flow of water from the inlet 102 to the selected outlet(s) 104,106. The pipes 110,112 are preferably arranged concentrically. In this embodiment, the inner one of the pipes 110 is fixed and the outer pipe 112 is slidable along the inner pipe 110. This may not be essential however and the outer pipe 112 may be fixed and the inner pipe 110 slidable within the outer pipe 112.

A transverse partition wall 114 within the inner pipe 110 separates the inlet 102 from the outlet 104 and a sleeve 150 received within the inner pipe 110 on one side of the partition wall 114 separates the inlet 102 from the outlet 106. A pair of O-ring seals 152,154 provide a fluid tight seal between the sleeve 150 and the inner pipe 110.

The inner pipe 110 is provided with three annular arrays of through holes 116,118*a*,118*b* in the pipe wall. Each array consists of a plurality of holes, in this case, two, although more than two may be employed. In some applications one or both arrays may be replaced by a single hole.

The holes 116 form an inlet array and the holes 118*a*,118*b* form outlet arrays on opposite sides of the inlet array. The holes 116,118*b* are arranged on one side of the partition wall 114 and the holes 118*a* are arranged on the other side of the partition wall 114.

The holes 116 communicate with the inlet 102 via the sleeve 150. The holes 118*a* communicate with the outlet 104 and the holes 118*b* communicate with the outlet 106 via a flow channel 156 defined between the inner pipe 110 and the sleeve 150.

The outer pipe 112 is provided with three internal ribs or lands 120,122,124 in which O-ring seals 120*a*,122*a*,124*a* are mounted. The lower land 120 as viewed in the drawings is provided by an annular insert 158 received within the end of the outer pipe 112.

The O-ring seals 120*a*,122*a*,124*a* are axially spaced apart and provide a fluid-tight seal with the outer surface of the inner pipe 110 to separate an annular clearance gap between the pipes 110,112 into two annular flow channels 130,132.

In use, the outer pipe 112 is axially slidable along the inner pipe 110 to select the flow channel 130,132 communicating with the inlet and outlet arrays of holes 116,118*a*,118*b* and thus control the flow of water from the inlet 102 to the selected outlet(s) 104,106 individually or in combination.

Figure 13:
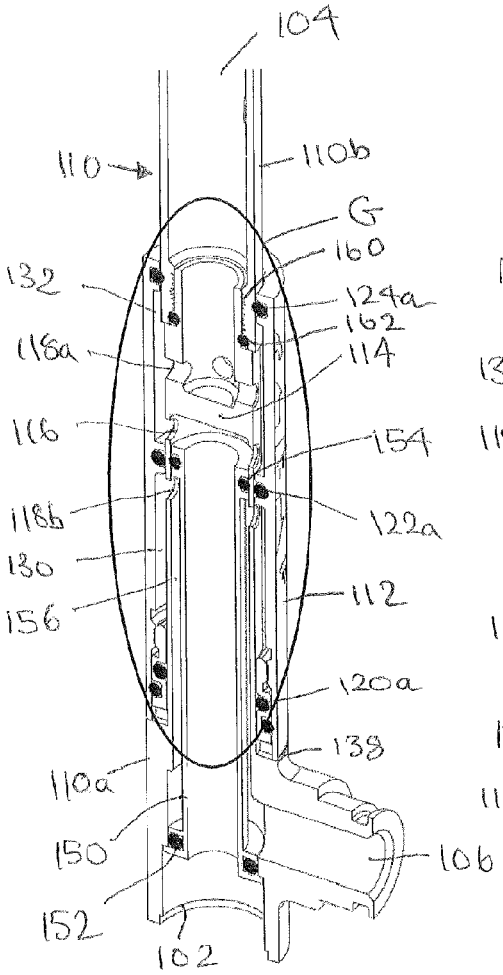
FIG. 13 is a cut-away perspective view of a water diverter system according to a second embodiment of the invention with the diverter arranged in a first flow-on position.
Figure 14:
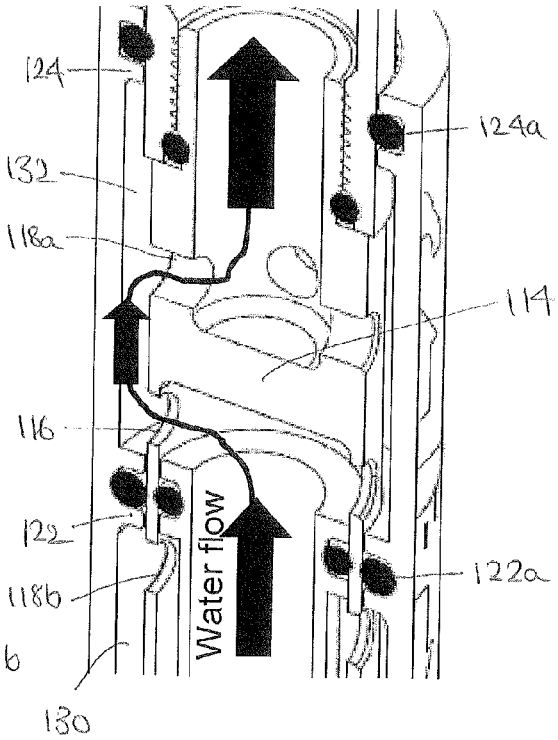
FIG. 14 is an enlarged detail view of the area G in FIG. 13.

FIGS. 13 and 14 show the diverter system in a first position in which the array of holes 116,118*a* open to the flow channel 132 and the array of holes 118*b* opens to the flow channel 130. As a result, water flows from the inlet 102 to the outlet 104 and the outlet 106 is isolated from the inlet 102.

This corresponds to an end position in which the outer pipe 112 is axially located against an abutment 138 of the inner pipe 110. In this embodiment the abutment 138 is provided by an annular shoulder but any suitable abutment means may be employed.

Figure 15:
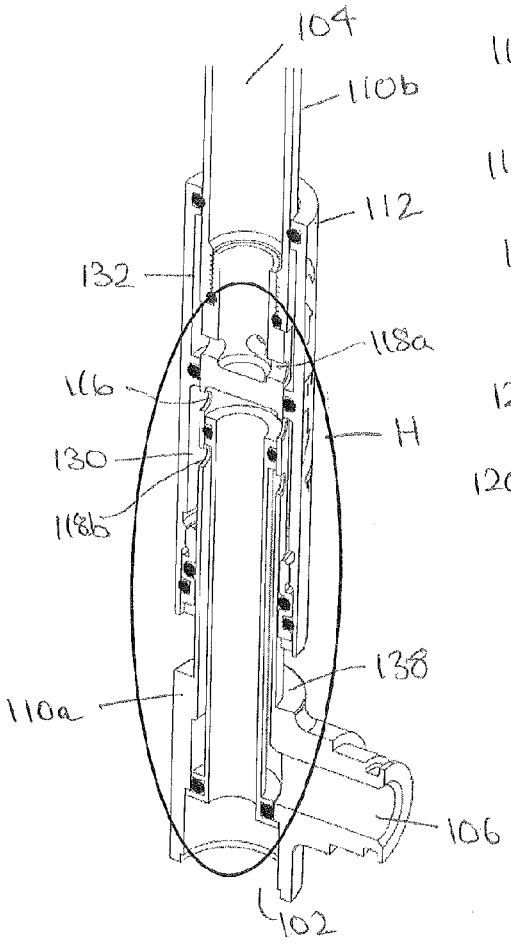
FIG. 15 is a cut-away perspective view of the water diverter system of FIG. 13 with the diverter arranged in a second flow-on position.
Figure 16:
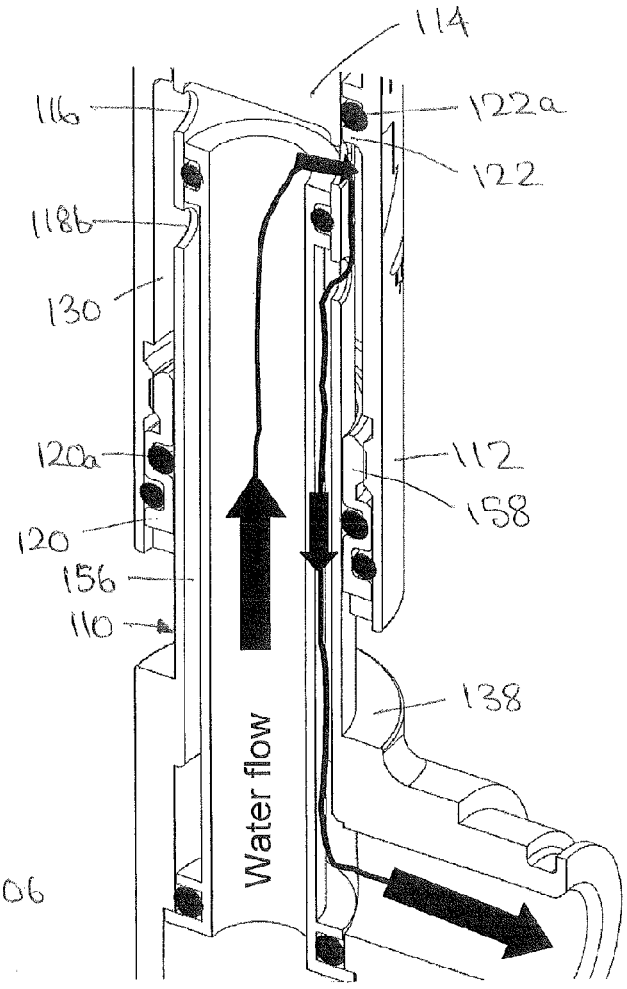
FIG. 16 is an enlarged detail view of the area H in FIG. 15.

FIGS. 15 and 16 show the diverter system in a second position in which the outer pipe 112 is moved away from the abutment 138 so that the array of holes 116,118*b* open to the flow channel 130 and the array of holes 118*a* open to the flow channel 132. As a result, water now flows from the inlet 102 to the outlet 106 and the outlet 104 is isolated from the inlet 102.

Figure 17:
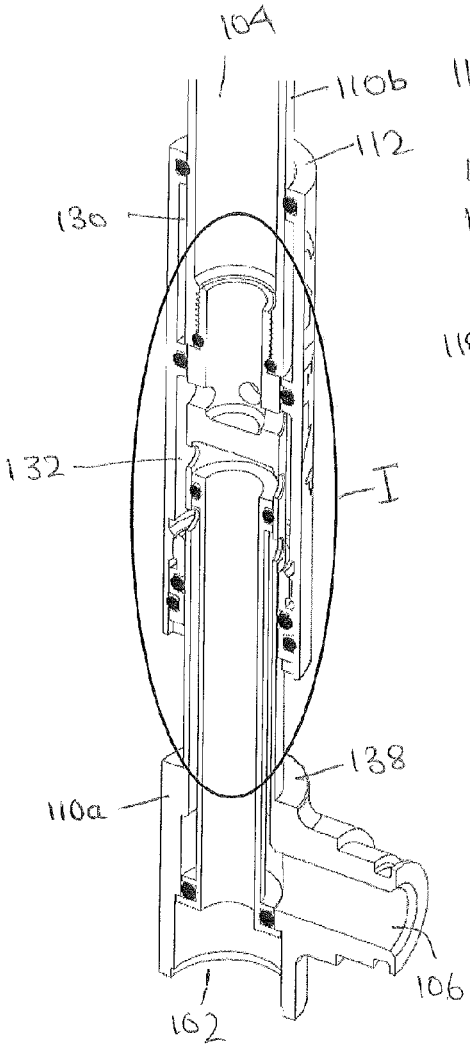
FIG. 17 is a cut-away perspective view of the water diverter system of FIG. 13 with the diverter arranged in a third flow-on position.
Figure 18:
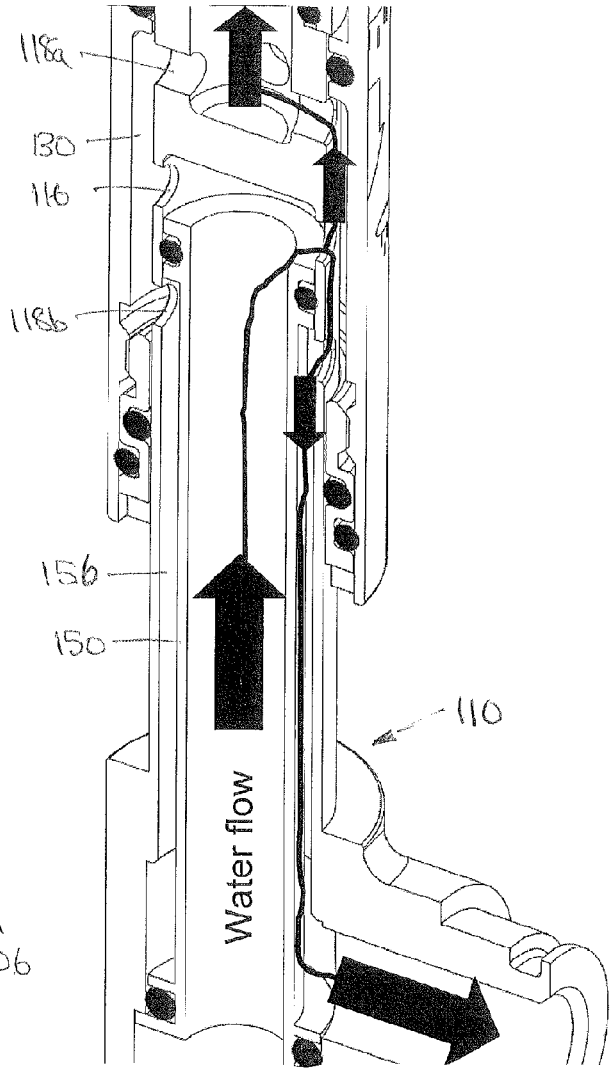
FIG. 18 is an enlarged detail view of the area I in FIG. 17.

FIGS. 17 and 18 show the diverter system in a third position in which the outer pipe is 112 is moved further away from the abutment 138 so that all three arrays of holes 116,118*a*,118*b* open to the flow channel 130. As a result, water now flows from the inlet 102 to both outlets 104,106.

The outer pipe 112 may be movable beyond the position shown in FIGS. 17 and 18 to a fourth position (not shown) so that the array of holes 116,118*a* open to the flow channel 132 and the array of holes 118*b* is isolated from the flow channel 132 so that water flows from the inlet 102 to the outlet 104 again.

It will be understood that the outer pipe 112 may be movable to a fifth position (not shown) in which the outlets 104, 106 are isolated from the inlet 102 to prevent fluid flow.

In the above-described embodiment, the inlet 102 and both outlets 104,106 are associated with the fixed inner pipe 110 and do not move. As a result, axial sliding movement of the outer pipe 112 to selectively connect the inlet 102 to the outlets 104,106 individually or in combination does not change the positions of the inlet 102 and outlets 104,106. This arrangement allows greater freedom in the fluid connections that can be made to inlet 102 and/or outlets 104,106. In other arrangements, one or more of the fluid connections may be movable.

Also in the above-described embodiment, the inner pipe 110 comprises two parts 110*a*,110*b* that are secured together by engagement of mating screw threads 160 and sealed by an O-ring 162 above the partition 114. The 102 and outlet 106 are provided by the first part 110*a* and the outlet 104 is provided by the second part 110*b*. Other configurations of the inner pipe and/or the inlet and/or outlets are possible.

As will be appreciated from the description of exemplary embodiments, the invented diverter system enables fluid from a single supply to be diverted to two or more outlets separately or in combination.

It will be understood that the description of the exemplary embodiments is not intended to be limiting, and the features of the embodiments may be modified to suit a particular application. For example, while the embodiments show the inlet connected to the inner pipe and the outlets connected to the inner pipe and/or outer pipe, it will be appreciated that the inlet and outlet connections may be changed from those shown to suit requirements for a particular installation.

The diverter system may be configured so that water flow can be shut-off as described. This may be desirable where a separate on/off flow control is not provided in some other part of the installation. However, this is not essential and may be dispensed with where a separate on/off flow control is provided elsewhere. For example a mixer valve may be employed with an on-off flow control function or a separate on-off valve may be provided upstream of the diverter system.

The diverter system has application to both new and existing water supply installations. For example an existing water supply system having a single outlet supplied by a mixer valve or other suitable water source may be converted to a multiple outlet system by inserting the diverter system between the water source and the existing outlet, preferably where it is accessible for operation by a user.

In the above-described embodiments, this may be achieved by breaking into the existing water supply line and connecting the water supply line to the inner pipe so that the outer pipe can slide along the inner pipe to supply water to selected outlet(s) as described above. Other arrangements for adapting an existing installation are possible and within the scope of the invention.

The diverter system may be employed with the pipes arranged vertically as shown in the drawings or horizontally or at any angle between horizontal and vertical.

The concentric arrangement of the pipes may allow relative rotational movement between the pipes as well as relative axial position. Relative rotational movement may be employed to change the direction in which water is discharged from an outlet. Relative rotational movement may be permitted in any axially adjusted position. Relative rotational movement may be employed to control flow rate and may provide an on-off function.

In the preferred embodiments above-described the diverter system is configured with an inlet connected to a supply and two or more outlets. However, the diverter system could be configured with two or more inlets connected to the same or different supplies and one or more outlets. Any number of fluid connection points may be provided to serve as inlets or outlets to suit the requirements of a particular installation.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention extends to and includes any of the features described herein either separately or in combination with any other feature.

The invention claimed is:

1. A diverter device for directing a water supply installation for washing, showering or bathing, the diverter device comprising:

a fluid inlet;

at least two fluid outlets;

an elongate inner tubular member in fluid communication with the fluid inlet and one of the fluid outlets; and an elongate outer tubular member mounted on the inner tubular member and being axially slidable along the inner tubular member between at least first and second positions;

wherein one of the inner and outer tubular members is in fluid communication with another of the fluid outlets;

wherein the outer tubular member defines with the inner tubular member a series of fluid flow channels configured to control fluid flow between the fluid inlet and the fluid outlets;

wherein when the outer tubular member is in the first position, the fluid inlet is in fluid communication with an individual fluid outlet via one flow channel; and wherein when the outer tubular member is in the second position, the fluid inlet is in fluid communication with the at least two fluid outlets via another fluid flow channel.

2. The diverter device of claim 1 wherein the tubular members are arranged concentrically.

3. The diverter device of claim 1 wherein at least one outlet is provided by the inner tubular member and at least one further outlet is provided by the outer tubular member.

4. The diverter device of claim 1 wherein all the outlets are provided by the inner tubular member.

5. The diverter device of claim 1 wherein one or more holes is provided in a wall of the inner tubular member for fluid to flow from the inlet to a flow channel aligned with the hole(s).

6. The diverter device of claim 1 wherein at least one flow channel isolates the inlet from all the outlets.

7. The diverter device of claim 1 wherein relative axial movement of the tubular members is accommodated by a flexible or telescopic connection to an outlet associated with the movable member.

8. The diverter device of claim 1 wherein relative axial movement of the tubular members is accommodated by repositioning an outlet fitting associated with the movable member.

9. The diverter device of claim 1 wherein the inlet is connectable to a source of temperature controlled water and the outlets supplying water to an appliance selected from a shower, bath, or washbasin.

10. The diverter device of claim 1 wherein the inner tubular member is in fluid communication with the another fluid outlet.

11. The diverter device of claim 1 wherein the outer tubular member is in fluid communication with the another fluid outlet.

12. The diverter device of claim 11 wherein the outer tubular member is rotatable relative to the inner tubular member for adjusting an angular position of the another fluid outlet.

13. In an ablutionary installation for washing, showering and bathing, a manually operable diverter for controlling flow of temperature controlled water to a plurality of outlets separately or in combination, the diverter comprising:

an inner tubular member having an inlet connectable to a source of temperature controlled water; and an outer tubular member defining with the inner tubular member a series of fluid flow channels between an outer surface of the inner tubular member and an inner surface of the outer tubular member;

wherein the outer tubular member is axially slidable along the inner tubular member between at least first and second positions;

wherein when the outer tubular member is in the first position, the fluid inlet is connected to a first fluid flow channel to deliver temperature controlled water from the fluid inlet to one outlet; and wherein when the outer tubular member is in the second position, the fluid inlet is connected to a second fluid flow channel to deliver temperature controlled water from the fluid inlet to the at least two fluid outlets.

14. A diverter device for directing a fluid flow, comprising:

an outer tubular member having at least one fluid outlet;

at least one additional fluid outlet; and an inner tubular member having a fluid inlet for receiving the fluid flow, the inner tubular member is disposed within the outer tubular member, such that the inner and outer tubular members together define a plurality of fluid flow channels configured to direct the fluid flow between the fluid inlet and the at least two fluid outlets;

wherein one of the inner and outer tubular members is axially slidable relative to the other tubular member between at least first and second positions;

wherein when the respective tubular member is in the first position, the fluid inlet is in fluid communication with one fluid outlet via one of the fluid flow channels; and wherein when the respective tubular member is in the second position, the fluid inlet is in fluid communication with at least two fluid outlets via another fluid flow channel.

15. The diverter device of claim 14, wherein the outer tubular member has at least two fluid outlets.

16. The diverter device of claim 15, wherein the at least one additional outlet is a fluid outlet of the inner tubular member.

17. The diverter device of claim 16, wherein the fluid outlet and the fluid inlet of the inner tubular member are disposed at opposing ends thereof.

* * * * *